US009816726B2

(12) United States Patent
Le Mer

(10) Patent No.: US 9,816,726 B2
(45) **Date of Patent: *Nov. 14, 2017**

(54) DOOR WITH A BUILT-IN BURNER FOR A HEATING APPLIANCE

(71) Applicant: Giannoni France, Morlaix (FR)

(72) Inventor: Joseph Le Mer, Plouezoch (FR)

(73) Assignee: Giannoni France (FR)

( * ) Notice: Subject to any disclaimer, the term of this patent is extended or adjusted under 35 U.S.C. 154(b) by 403 days.

This patent is subject to a terminal disclaimer.

(21) Appl. No.: 14/618,308

(22) Filed: Feb. 10, 2015

(65) Prior Publication Data

US 2015/0153067 A1 Jun. 4, 2015

Related U.S. Application Data

(63) Continuation of application No. 13/254,593, filed as application No. PCT/EP2010/051126 on Jan. 29, 2010, now Pat. No. 8,978,638.

(30) Foreign Application Priority Data

Mar. 6, 2009 (FR) ..... 09 51422

(51) Int. Cl.
*F24H 9/00* (2006.01)
*F24H 9/18* (2006.01)
(Continued)

(52) U.S. Cl.
CPC ..... *F24H 1/145* (2013.01); *F23D 14/62* (2013.01); *F23D 14/70* (2013.01); *F23M 7/00* (2013.01);
(Continued)

(58) Field of Classification Search
CPC ..... F23D 14/62; F23D 14/70; F23D 2900/00003; F23M 7/00; F23M 7/04;
(Continued)

(56) References Cited

U.S. PATENT DOCUMENTS 1,766,191 A 6/1930 Russell
1,777,065 A 9/1930 Yale
(Continued)

FOREIGN PATENT DOCUMENTS

DE 206577 C 2/1909
DE 8800650 U1 2/1988
(Continued)

OTHER PUBLICATIONS

International Search Report, PCT/EP2010/051126, dated Apr. 27, 2010.

*Primary Examiner* — Steven B McAllister
*Assistant Examiner* — Steven Anderson, II
(74) *Attorney, Agent, or Firm* — Lerner, David, Littenberg, Krumholz & Mentlik, LLP

(57) ABSTRACT

A door with a gas burner on an inner surface and a system for carrying a combustible gas to the burner on the outer surface thereof. The door comprises a pair of metal sheets rigidly connected to one another at the edges thereof, each sheet having input and output openings for the gas mixture that are mutually separated in order to leave an inner space receiving a deflector plate serving as a thermal shield to be swept over on either side by the flow of the gas mixture supplying the burner. This arrangement reduces heat loss through the door; thus, keeping the outer surface cold, avoiding the risk of burns, and preheating the gas mixture. The invention can be used in heating appliances.

20 Claims, 7 Drawing Sheets

(51) Int. Cl.

| | |
|---|---|
| ***F24H 9/02*** | (2006.01) |
| ***F24H 1/14*** | (2006.01) |
| ***F23D 14/62*** | (2006.01) |
| ***F23D 14/70*** | (2006.01) |
| ***F23M 7/00*** | (2006.01) |
| ***F23M 7/04*** | (2006.01) |
| ***F24H 1/43*** | (2006.01) |

(52) U.S. Cl.
CPC ..... *F23M 7/04* (2013.01); *F24H 1/43* (2013.01); *F24H 9/0042* (2013.01); *F24H 9/02* (2013.01); *F24H 9/1836* (2013.01); *F23D 2900/00003* (2013.01); *F23D 2900/00018* (2013.01)

(58) Field of Classification Search
CPC ..... F24H 9/0042; F24H 9/1836; F24H 9/02; F24H 1/145
See application file for complete search history.

(56) References Cited

U.S. PATENT DOCUMENTS

| | | | |
|---|---|---|---|
| 3,614,388 | A | 10/1971 | Robinson |
| 4,871,014 | A | 10/1989 | Sulzberger |
| 5,678,988 | A | 10/1997 | Amrhein et al. |
| 6,442,864 | B2 | 9/2002 | Ringer et al. |
| 7,281,497 | B2 | 10/2007 | Le Mer et al. |
| 7,370,704 | B2 | 5/2008 | Harris |
| 2003/0075046 | A1 | 4/2003 | Lenzing |

FOREIGN PATENT DOCUMENTS

| | | | |
|---|---|---|---|
| DE | 4443045 | A1 | 6/1995 |
| EP | 0141707 | A2 | 5/1985 |
| EP | 0678186 | A1 | 10/1995 |
| EP | 1562006 | A1 | 8/2005 |
| FR | 362304 | A | 6/1906 |
| FR | 429885 | A | 10/1911 |
| FR | 2794521 | A1 | 12/2000 |
| FR | 2846075 | A1 | 4/2004 |
| FR | 2854229 | A1 | 10/2004 |
| GB | 959310 | A | 5/1964 |
| WO | 94/16272 | A1 | 7/1994 |
| WO | 03/062705 | A1 | 7/2003 |
| WO | 2004/036121 | A1 | 4/2004 |
| WO | 2004/097311 | A1 | 11/2004 |
| WO | 2007/051998 | A1 | 5/2007 |

DOOR WITH A BUILT-IN BURNER FOR A HEATING APPLIANCE

CROSS-REFERENCE TO RELATED APPLICATIONS

The present application is a continuation of U.S. patent application No. 13/254,593, filed on Sep. 21, 2011, which application is a national phase entry under 35 U.S.C. §371 of International Application No. PCT/EP2010/051126, filed Jan. 29, 2010, which claims priority from French Patent Application No. 09 51422, filed Mar. 6, 2009, all of which are incorporated herein by reference.

The present invention relates to a thermally insulated door with a built-in burner.

It notably applies to heating appliances including a tube, or a set of tubes, in which flows a fluid to be heated up, for example water, and the wall of which is exposed to the combustion gases generated by the burner.

This "door" is a wall, which is removable so as to allow maintenance of the appliance, in particular the periodic cleaning of the burner. It is for example attached by means of a series of peripheral screws at a fixed perimeter (frame) of the front of the appliance.

The burner is attached in the central portion of the door, on its internal face, so that it is positioned in the inner space of the device, in proximity to the tube(s) when the door is closed. The external face of the door is connected to a sleeve for feeding a combustible gas mixture (for example fuel gas/air or fuel oil/air), and the transfer of this mixture to the burner is accomplished through a suitable opening made in the door. Generally, the feeding of the gas mixture into the sleeve is accomplished by means of a fan.

Conventionally, the zone of the inner face of the door which surrounds the burner is filled with a heat resistant and thermally insulating material, for example a plate in a ceramic-based material, the actual door being in metal, generally in molded aluminum.

The device being in operation, the temperature of the gases from the burner has a value which, as an indication, is generally comprised between 950 and 1,000° C. In spite of the presence of this insulating lining, the temperature of the external face of the door may attain a temperature comprised between 120 and 180° C. approximately.

This thermal radiation lowers the global yield of the device in a non-negligible way; thus, for a door with a circular shape, with a diameter of 220 mm, the energy loss may be of the order of 150 Wh, i.e. 540 kJ (depending on the rated power of the burner).

Moreover, because the external face of the door is brought to a relatively high temperature, a risk of burns occurs for the persons which may come into contact with this door, notably for the operator responsible for maintenance and adjustments of the device.

A first object of the invention is to propose a door notably reducing this loss, therefore improving the yield of the appliance.

A second object of the invention is to propose a simple, lightweight, easy-to-make, inexpensive door structure which lends itself to high volume automated production.

A third object of the invention is to propose a door, the design of which improves the quality of the combustion of the burner.

A fourth object of the invention is to improve safety by avoiding risks of burns.

Therefore the invention relates to a door with a built-in burner for a heating appliance, and this door is provided on its internal face with a gas burner and on its external face with a system for feeding a combustible gas mixture to the burner; it is adapted so as to be able to be engaged into the frame of a wall of the appliance, and for being removably attached to this frame.

According to the invention, this door includes a pair of metal sheets firmly attached to each other at their periphery, the outer sheet having in its central zone an inlet opening for the arrival of said gas mixture while the inner sheet has in its central zone an outlet opening, coaxial with said inlet opening, to which is attached the burner, both of these metal sheets being set away from each other, making between them a space inside which a deflector plate is fixedly mounted, the latter having the shape of a disc, the diameter of which is substantially larger than that of said inlet and outlet openings of said door, and being mounted centered on the axis of these openings and perpendicular to the latter, this deflector plate consisting of two slightly spaced apart parallel metal sheets, attached to each other at their periphery, this deflector plate thus being shaped and dimensioned so that the gas mixture flow penetrating into the appliance through said inlet opening is deflected towards the outside of the deflector plate, circumvents the peripheral edge thereof from the outside towards the inside, and then flows onto its internal face, in order to flow out through said outlet opening and penetrate into the burner.

By this layout, the gas mixture streams penetrating into the appliance follow a staggered trajectory; these cold currents firstly lick the internal face of the outer sheet and the external face of the deflector plate, which acts as a heat shield, and then the internal face of the latter before attaining the combustion surface of the burner.

The outer metal sheet which is exposed to ambient air remains cold or warm, according to the sought purpose. Further, preheating the mixture before its arrival at the burner improves the quality of the combustion and the yield of the appliance.

According to other possible advantageous but non-limiting characteristics of the invention:

- said inlet and outlet openings are circular;
- said deflector plate has, on the peripheral edge portion of its internal face, pads or bosses via which this face is applied and fixed against the external face of said inner metal sheet, this through quasi point-like contact zones, which do not impede the passage of the gas mixture, while limiting transmission of heat from the inner metal sheet to the deflector plate;
- said deflector plate is provided with a thermal insulator inserted between said metal sheets, this insulator consisting in a neutral gas, such as nitrogen for example, or in a solid material, for example based on ceramic;
- the constitutive inner metal sheet of said deflector plate has a bulging central portion which allows its elastic deformation and allows it to absorb the stresses generated by the expansions and contractions related to changes in temperature, depending on whether the appliance is operating or is stopped;
- the constitutive outer metal sheet of said deflector plate has a nipple-shaped central portion, the tip of which is turned towards the inlet opening, this nipple promoting radial distribution of the flow of the gas mixture penetrating through said inlet opening;
- said burner is flat, its combustion surface being perpendicular to the axis of said openings;
- said burner is slightly bulging, its combustion surface being convex and centered on the axis of said openings;

said burner is annular, its cylindrical combustion surface being centered on the axis of said opening;

the zone of the inner sheet which surrounds the outlet opening is lined on its internal face with a heat resistant and thermally insulating material, such as a ceramic material or based on ceramic;

the door is provided on its internal face with a peripheral seal gasket capable of being applied against the external face of a collar firmly attached to said wall frame;

the system for feeding the combustible gas mixture comprises a sleeve mounted at the inlet opening of said outer sheet and attached to the latter;

the door is equipped with an electric motor fan which is firmly attached to said outer sheet and is adapted in order to suck in the gas mixture through said inlet opening and to drive it back towards the burner;

said motor fan is of the centrifugal type and has a series of rotary vanes which are housed in a wall recess of said outer sheet, which acts as a case, and extends in proximity to the external face of the deflector plate;

the stator of said motor fan is positioned inside the inlet opening of said outer sheet on the one hand, and the system for feeding the combustible gas mixture comprises an annular collector mounted at this inlet opening and attached to the outer sheet on the other hand, thereby surrounding the stator of said motor fan, this collector being fed with gas fuel through a conduit and its wall being pierced with a plurality of radial orifices through which the gas fuel is diffused into the annular interstice separating the stator from the edge of the inlet opening, so as to be then sucked by said rotating vanes, at the same time as ambient air (oxidizer) which is sucked up by this same annular interstice.

Other characteristics and advantages of the invention will become apparent upon reading the following description of different possible embodiments of the invention.

This description is made with reference to the appended drawings wherein.

In FIGS. 1, 3, 4 and 6, the circulation of the gas streams has been made visible by arrows, the appliance being considered as operating.

The same reference figures and letters were used for the sake of good clarity in order to designate identical or similar elements of the different illustrated embodiments.

Figure 1:
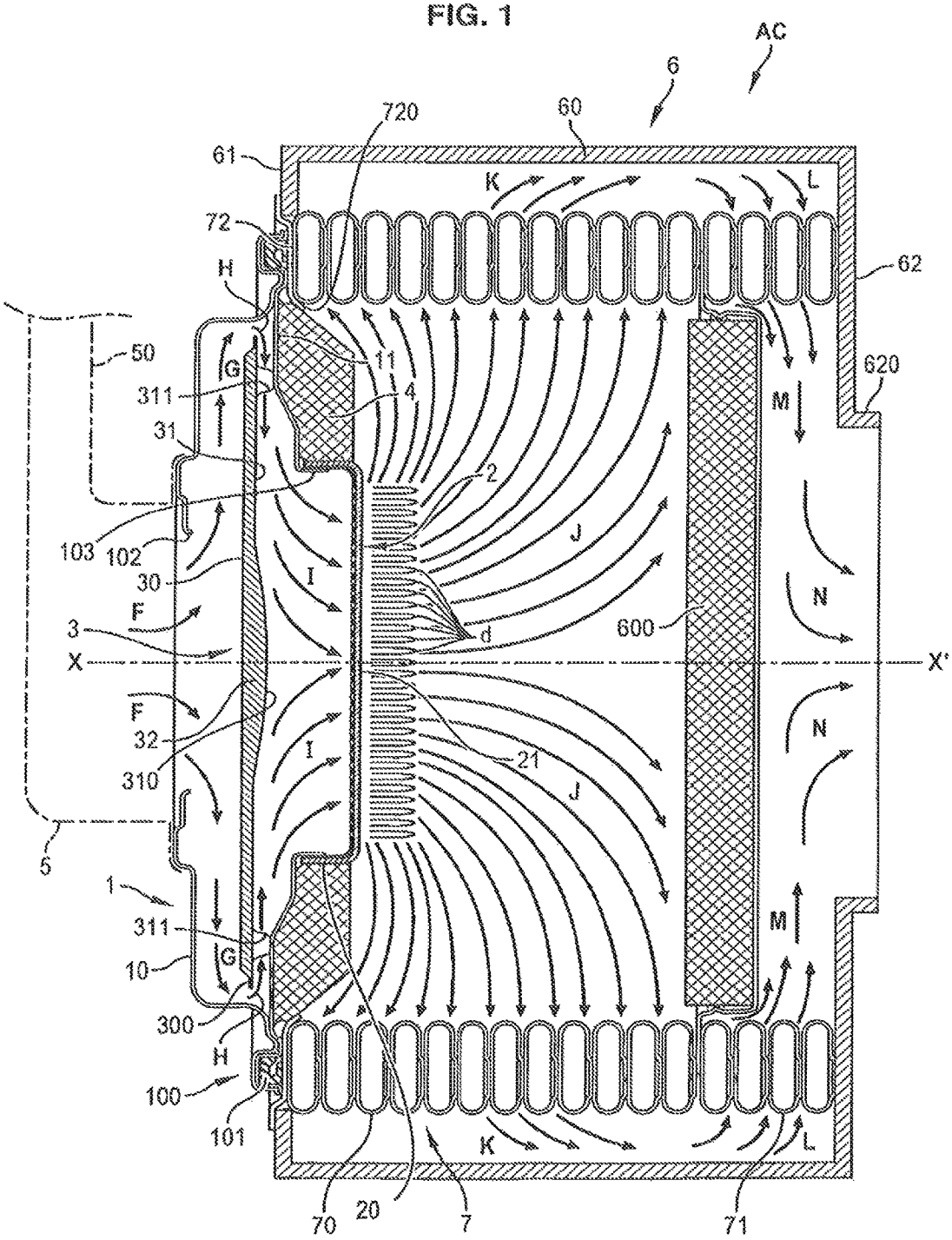
FIG. 1 is an axial sectional front view of a heating appliance equipped with a door which is the object of the first embodiment of the invention, wherein the burner built into the door is flat.
Figure 2:
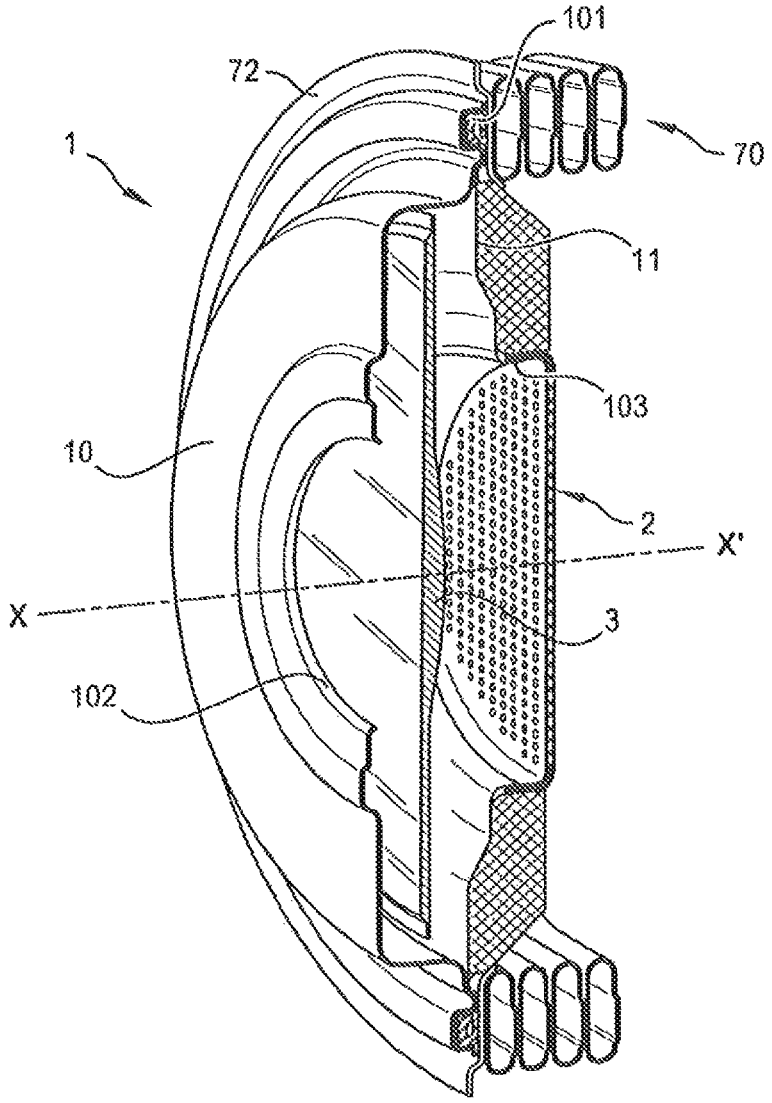
FIG. 2 illustrates the same door in a perspective, also sectional view.

In FIGS. 1 and 2, reference 1 designates the door with a built-in burner 2, being the object of the invention.

The latter may be adapted to different types of heating appliances.

In the illustrated embodiments, this is simply as an example a heat exchanger with condensation of the kind produced by Giannoni France under the designation "Isothermic" (registered trademark).

This type of exchanger includes two bundles of helicoidal tubes coaxially mounted inside a gas-proof casing, separated by a partition in a thermally insulating material. The fluid to be heated, water for example flows through the tubes. They have an ovalized flattened section and the interstice between turns is calibrated and of small width. The burner is located inside one of the bundles, a so-called primary bundle, and the hot gases stemming from the burner cross these interstices from the inside towards the outside, with a high heat exchange coefficient. They then circumvent the insulating partition and cross the interstices of the other bundle, a so-called secondary bundle, in the opposite direction (from the outside towards the inside), before being discharged out of the casing through a suitable conduit or sleeve.

Such an appliance, well known, will not be described in detail hereafter in order not to unnecessarily burden the present description.

However, if necessary, the reader may refer to the following patent documents which relate to an exchanger of this type: EP/B/0678186 (see notably FIG. 18), WO 2004/03621A1 (FIGS. 1 and 5) and WO 2004/097311A1 (see FIGS. 1-2).

The door 1 is attached in the frame 61 of the front wall of a heating appliance AC, the shell 6 of which has a side wall 60 and a bottom wall 62 having an exhaust sleeve 620 intended to be connected to a conduit (not shown) for discharging the burnt gases. This shell 6 contains a tubular helicoidal winding in stainless steel 7, with a flattened and oval section of axis X-X'. It consists of a primary bundle 70 and of a secondary bundle 71 separated by an insulating disc 600. This is a heat exchanger with condensation, of the same type as those described in the aforementioned documents, capable of heating water or any other fluid, which is circulated in the winding 7.

The door 1 has a general circular shape, centered on the axis X-X' and has peripheral attachment members (not shown) with which it may be removably mounted on the front of the appliance, for example by means of four lugs positioned at 90°, and screwed to the front.

The door 1 comprises a pair of walls with a small thickness, one being an outer wall 10, the other an inner wall 11. These walls are in cut-out and drawn stainless steel sheet.

They are attached to each other at their periphery, by crimping and/or welding; this peripheral edge 100 has an annular cavity, turned inwards which receives a seal gasket 101 capable of being applied, when the door is closed, against a supporting collar 72 attached in the frame 61 and in contact through its internal face against the first turn of the winding 7.

The drawn part of the outer sheet 10 is such that it has convexity directed outwards, the central zone of which is pierced with a circular opening 102 centered on X-X'. The wall bordering this opening has a profile adapted for mounting and sealably attaching—for example by means of screws or by welding—a sleeve 5 (illustrated in dashed lines) for feeding the combustible gas mixture into the appliance via a suitable conduit 50.

The drawn part of the inner sheet 11 is such that it has convexity directed inwards, the central zone of which is pierced with a circular opening 103 centered on X-X'. This opening is bordered by an annular mouth on which the burner 2 is attached. The latter has the shape of a cylindrical cup with a small height, the annular portion 20 of which is fitted and retained by tightening (force-fitting) and/or by a few welding points, on said mouth, while its flat bottom 21 is perforated, forming the combustion surface. In the illustrated embodiment, the burner has a composite structure, comprising an inner drawn perforated sheet and an outer fibrous and porous wall allowing good adherence of the flame.

Different structures (with a simple wall or a double wall notably) and different burner shapes may be provided.

Thus, the bottom 21 acting as a combustion surface may be slightly bulging with its convexity turned towards the inside of the appliance, and its centre of curvature centered on X-X'. With this curved shape expansion phenomena may be well absorbed, the combustion surface may naturally deform in order to assume a more or less pronounced curvature depending on this expansion.

Taking into account these "hollow" drawn shapes, a free space is available between both sheets 10 and 11.

In this space, is housed a discoidal plate 3 with small thickness, centered on X-X'. Its diameter is substantially larger than that of the openings 102 and 103; nevertheless it is slightly smaller than that of said free space.

The plate 3 consists of two thin walls 30, 31, for example in stainless steel sheet, attached to each other at their periphery 300 in a sealed way, for example by crimping and/or welding. The outer sheet is planar; the inner sheet 31 has a main annular zone also planar, parallel to the sheet 30 and a slightly bulging central zone 310, with convexity turned towards the inside (burner side).

Between the walls 30 and 31 is encapsulated an insulating material 32, for example a neutral gas such as nitrogen or a solid material based on ceramic. Its function is to limit heat transfer between both walls.

The inner wall 31 is provided at its periphery with several bosses, such as drawn portions 311, regularly distributed (for example six bosses at angles of 60°) via which it is attached to the sheet 11.

This attachment is for example made by welding points, in quasi point-like zones with limited surface area, in order to limit the heat transfer between both walls 11 and 31, and also in order not to impede the passage of the gas between the latter. These bosses thereby also act as spaces.

The door 1 includes on the inner side, an annular filling 4 with a thermally insulating and heat resistant material, for example in ceramic or in a material based on ceramic. This filling is axially fitted through its central opening onto the cylindrical portion 20 of the burner 2 and is retained against the internal face of the wall 11 by an internal edge of suitable shape 720 of the supporting collar 72. Thus, the annular filling 4 covers the wall 11 at the periphery of the burner, as far as the level of the winding 7, forming a heat screen with respect to the very hot gases from the burner present inside the primary bundle of the exchanger.

The burner having been lit by means of a suitable ignition system (not shown) and the air/gas fuel combustible mixture being fed into the sleeve 5 via the conduit 50, the appliance operates in the way explained hereafter.

The gas flow which enters the appliance crosses the opening 102, (arrows F), encounters the planar wall 30 of the plate 3 which faces it, and is burst into a multitude of gas streams which are deflected at right angles and which flow radially from the axis X-X' towards the outside of the disc, as far as the peripheral edge 300 (arrows G), while licking the wall 30; having arrived beyond the edge 300, they circumvent the latter (arrows H) and flow in the opposite direction, in the direction of the axis X-X', towards the outlet opening 103, this time by licking the wall 31 (arrows I) in order to penetrate into the inside of the burner 2.

The combustion visualized by inner cones d, generates very hot burnt gases (arrows J), the temperature of which is of the order of 950 to 1,000° C.

These gases cross the interstices between turns of the primary bundle 70 radially from the inside to the outside, flow out of the latter (arrows K), are channelled inside the shell 6, penetrate into the interstices between turns of the secondary bundle 71 (arrows L), which they cross radially from the outside to the inside, flow out of the latter (arrows M), and are discharged through the sleeve 620 (arrows N).

The fluid circulating inside the winding is first pre-heated in the secondary bundle 71 and then heated in the primary bundle 70 as this is well known.

When the appliance is operating, the inner metal sheet 31 of the deflector plate 3 is found at a substantially higher temperature than that of its outer sheet 30. Further, this temperature varies in a relatively significantly way, and frequently during phases for starting and stopping the appliance.

The result of this is successive expansions and retractions of this wall, higher than those of the outer wall, sources of mechanical stresses capable of altering in the long term the peripheral connection of both walls. However, this risk is suppressed by the presence of the central bulge 310 which may deform elastically, reversibly, by absorbing these stresses, so that they have no repercussion at the edge of the peripheral junction 300.

By the presence of the deflector plate 3, the heat losses of the appliance towards the outside are extremely low.

Indeed, only a small portion of the heat diffused by the metal sheet 11 is transmitted to this plate 3 on the one hand and almost the whole of the heat emitted at the front is recovered by the inflowing gas mixture which licks the hot walls during its staggered trajectory on the other hand. Furthermore, this preheating improves the quality of the combustion.

As an indication, if the gas mixture delivered by the sleeve 5 is found at a temperature of the order of 20 to 25° C., the temperature of the outer wall 10 of the door is of the order of 25 to 30° C., therefore clearly less than the temperature at which the external wall of a traditional door would be brought, a temperature which would correspond to the outer temperature of the wall 11 if the latter was not cooled by the inflowing gas mixture, i.e. between about 120 and 180° C.

Any risk of burns for an operator is consequently excluded.

Figure 3:
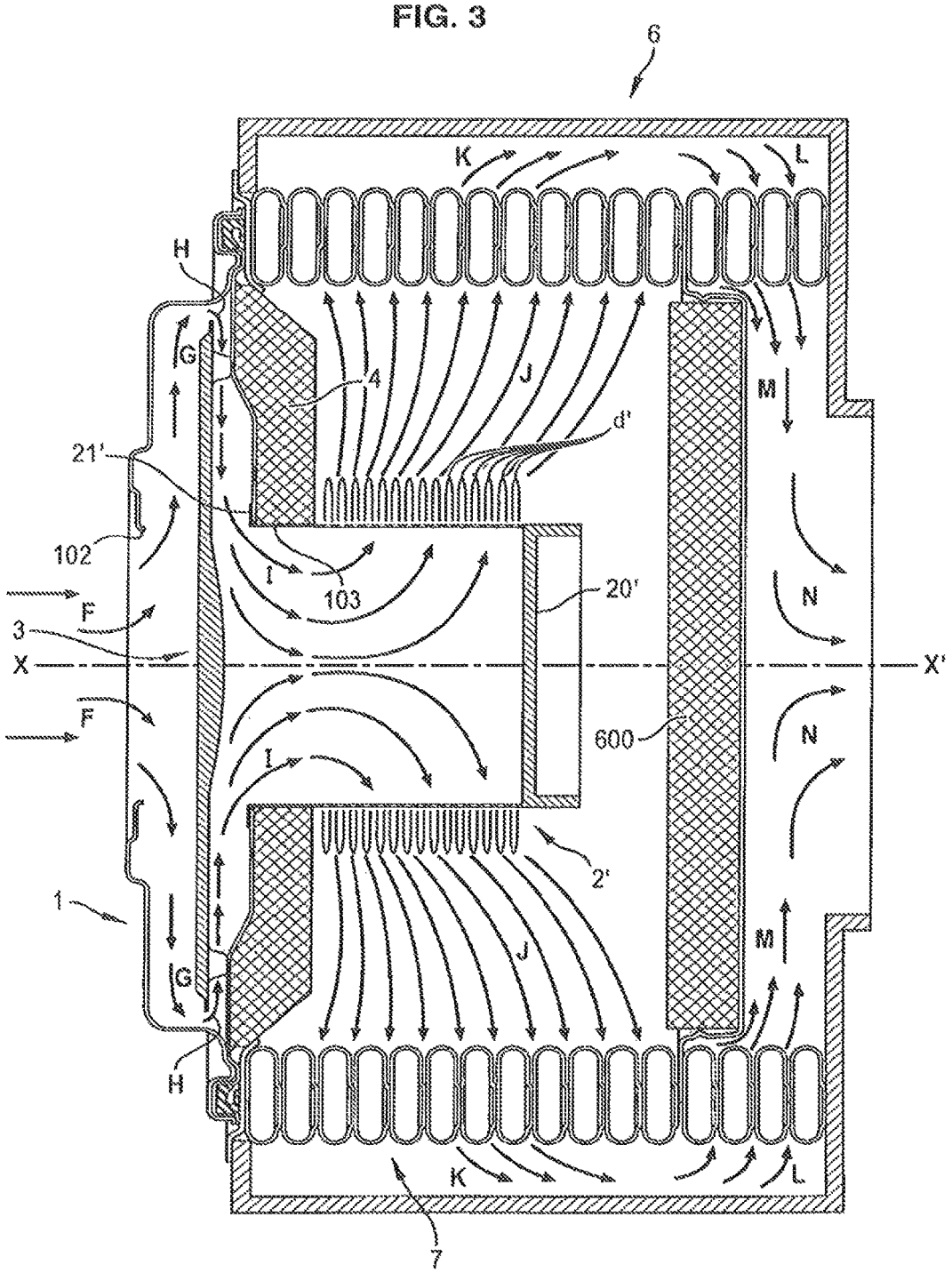
FIG. 3 is a view similar to that of FIG. 1, showing a second embodiment of the invention, wherein the burner built into the door is cylindrical.

FIG. 3 relates to an embodiment of the door 1 which differs from the previous one only by the type of burner built into the door.

Here, this is a cylindrical burner 2', with an axis X-X', closed by a flat bottom 20' and the inlet of which has a collar-shaped edge 21' which surrounds the central opening 103 of the internal sheet 11 and is attached to the latter, for example by a few welding spots.

The operation of the appliance is similar to the one described earlier.

Figure 4:
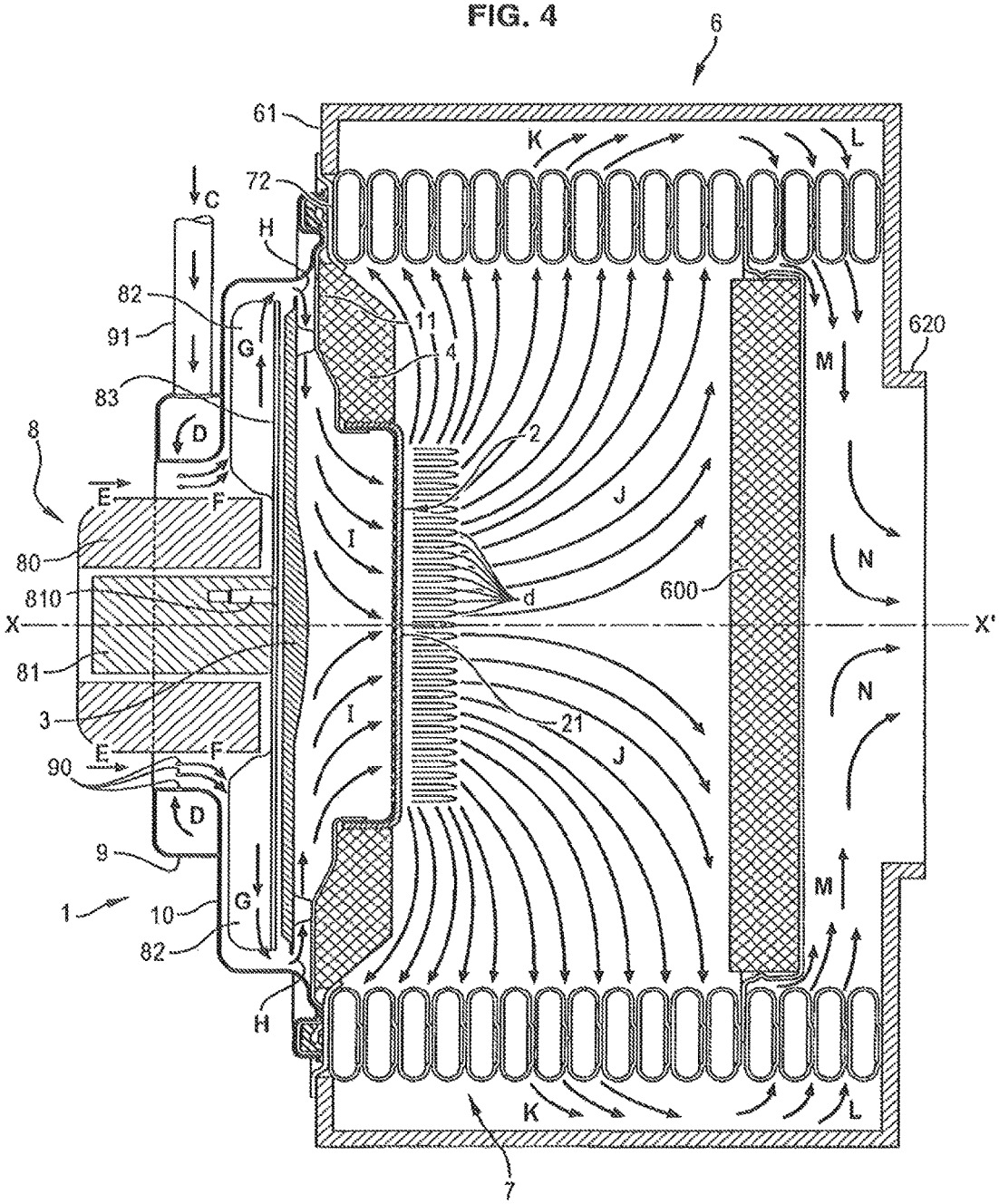
FIG. 4 is a view similar to that of FIG. 1, showing a third embodiment of the invention, wherein the door is equipped with a motor fan.
Figure 5:
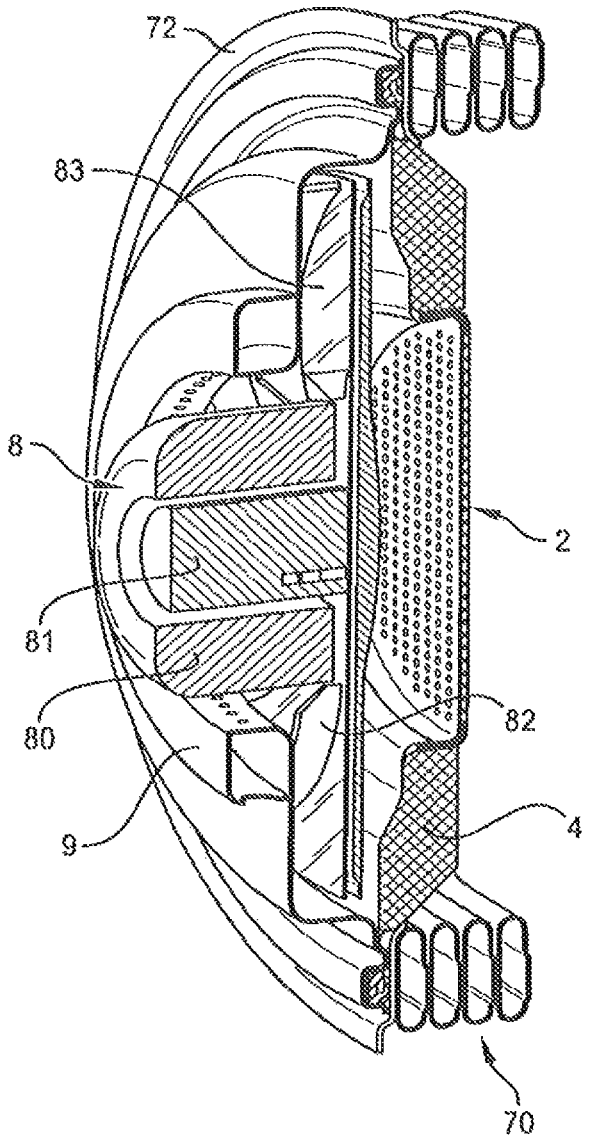
FIG. 5 illustrates the same door in a perspective, also sectional view.

FIGS. 4 and 5 relate to an embodiment of the door 1 which differs from that of FIGS. 1 and 2 by the fact that an electric motor fan 8 of the centrifugal type, centered on the axis X-X, is built into the door.

The latter comprises an annular stator 80 which is attached to the outer sheet 10 by means of suitable attachment tabs, not shown.

It includes a series of vanes 82 borne by a rotary disc 83 which is attached to its rotor 81 by means of screws 810. These vanes are housed in a circular recess with a suitable shape, formed in the wall of the outer sheet 10, which thus acts as a case for the latter.

The vane-bearing disc 83 extends in a general plane perpendicular to the axis X-X', very close to the external face of the deflector plate 3. The vanes 82 are attached on the external face of the disc 83.

The stator 80 of the motor fan is positioned with some play (annular space) inside the inlet opening 102 of the outer sheet 10. This opening has the shape of a mouth surrounded by an annular (approximately toric) collector 9 centered on the axis X-X'. This collector may be added to or forms an integral part of the sheet 10.

The collector 9 is connected to a conduit 91 for feeding a gas oxidizer such as butane or propane for example. Its internal annular wall and/or that of the mouth which surrounds, it is pierced with a plurality of orifices 90 regularly distributed at its periphery, allowing the gaseous oxidizer to be diffused as jets in the annular interstice surrounding the stator.

During operation, the rotor is in rotation, the gaseous oxidizer passes into the conduit 91 (arrows C), arrives in the annular collector 9 (arrows D), flows out through the orifices 90 and is sucked into the interior of the appliance by the moving vanes 82 (arrows F). The latter also suck ambient air (fuel) which is taken from the outside (arrows E) and passes into the same annular interstice, by mixing with the gas from the orifices 90.

Therefore, this is a combustible gas premix which is pulsed inside the door 1 by the motor fan 8.

The latter follows a path similar to the one already described above, with reference to FIG. 1 (arrows G, H and I) finally penetrating into the flat burner 2 after having circumvented the deflector plate 3.

According to the embodiment, the gas streams flowing out of the inlet mouth 102 do not actually lick the external face of the plate 3, however the effect is similar. The plate 3 acts as a heat shield; as it is not in contact with the rotary disc 83, there is no heat transmission between both of these elements, which protects the motor fan from rises in temperature.

Of course it is possible to equip a motor fan of this kind with a door provided with a cylindrical burner, like the one of FIG. 3.

Figure 6:
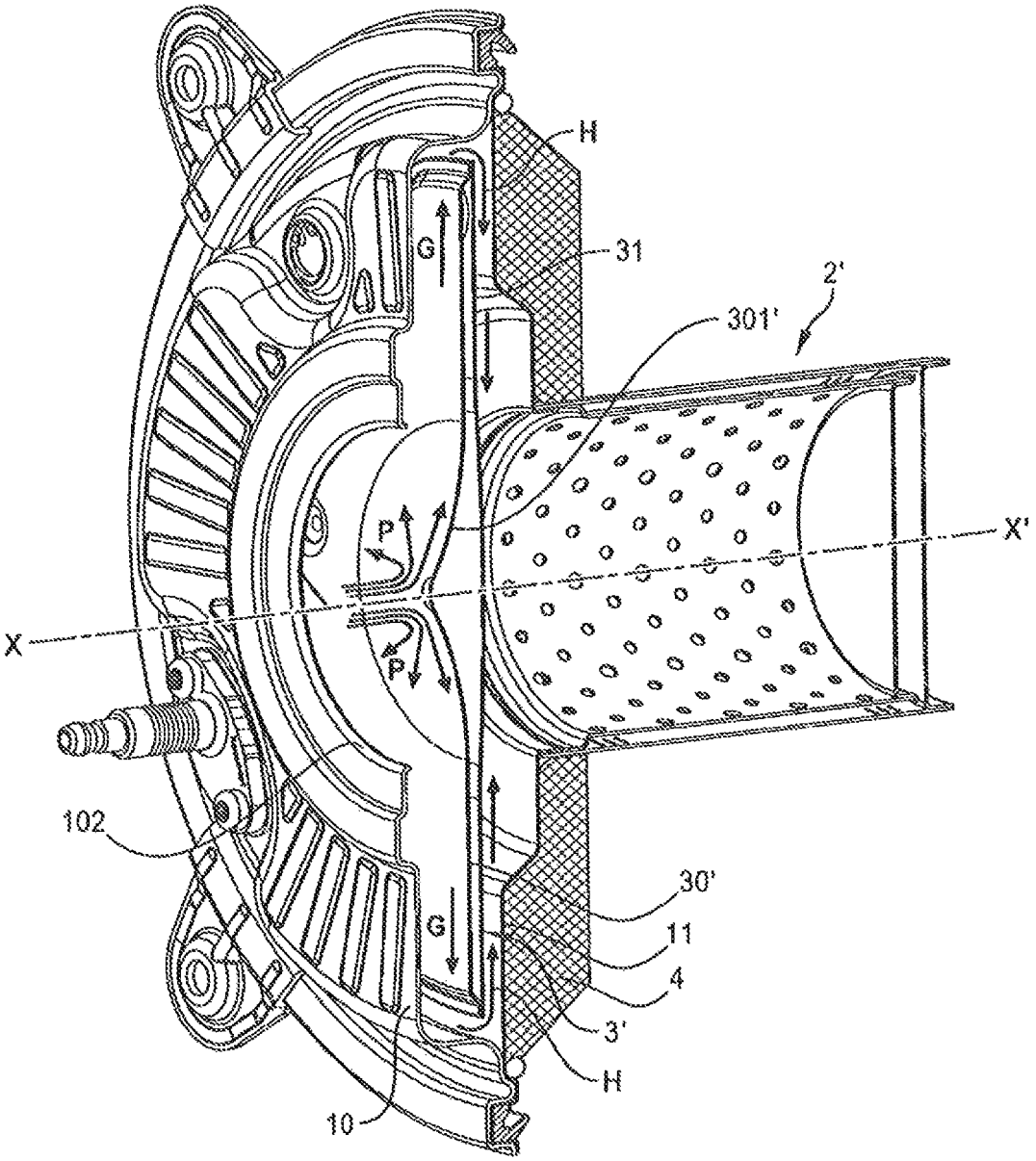
FIG. 6 is a sectional perspective view showing an alternative embodiment of the invention, wherein the deflector plate which equips the door has a protruding portion.
Figure 7:
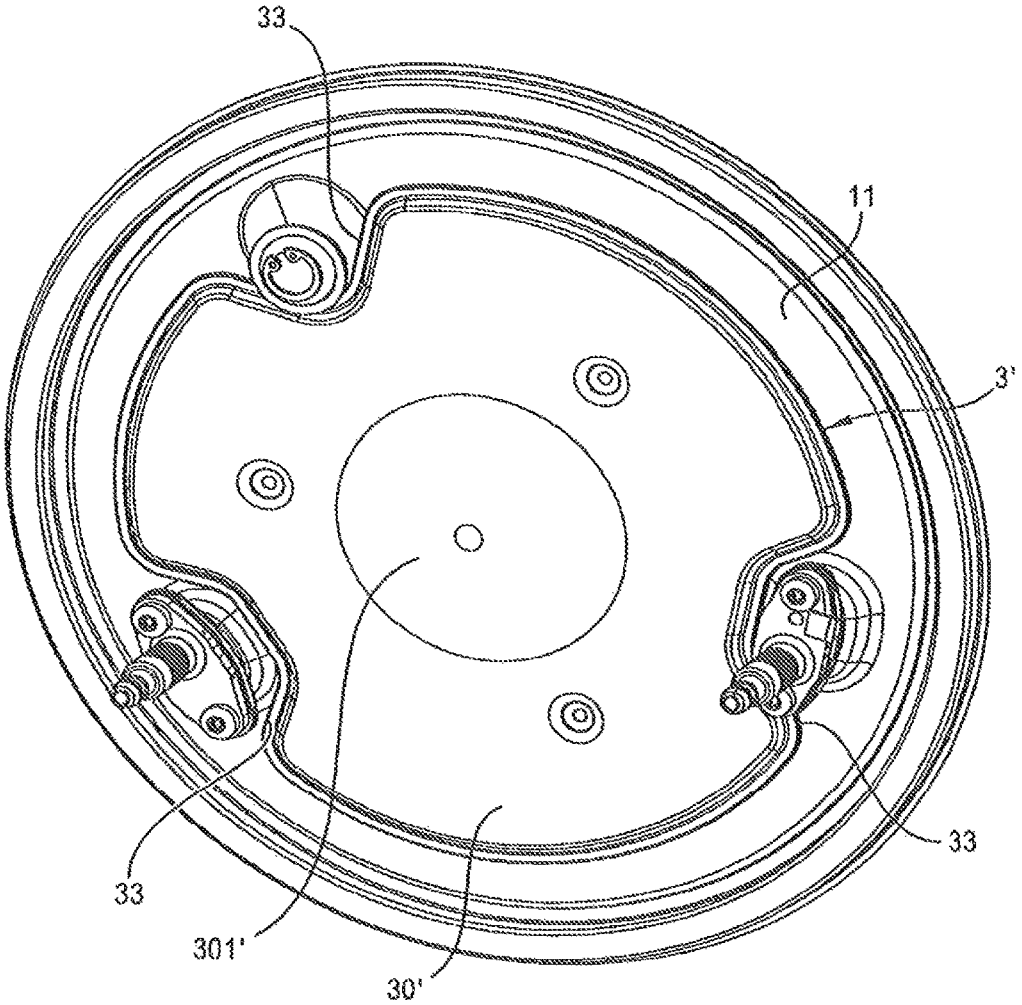
FIG. 7 is a perspective view which shows the inner sheet and the deflector plate of the door illustrated in FIG. 6.

FIGS. 6 and 7 relate to an alternative embodiment of the door 1, which differs from the previous ones by the shape of the outer sheet of the deflected plate. The latter is then referenced as 3'.

This outer metal sheet, referenced as 30', has a planar annular main zone, parallel to the inner sheet 31 and a protruding nipple-shaped central zone 301', the tip of which is turned towards the inlet opening 102 of the door 1.

This shape is for example obtained by drawing.

The nipple 301' improves the radial distribution of the inflowing airflow as illustrated by the arrows P.

Further, this reduces the pressure losses relatively to a planar surface.

By means of this particular shape of the central zone 301', the fan which brings the air/gas fuel combustible mixture, into the sleeve 5, is less urged and may rotate less faster in order to obtain a same flow rate.

In FIG. 7 it may be seen that the deflector plate 3' does not necessarily have a strictly circular contour, but it may have at its periphery, notches 53 of various shapes, adapted to the passage of various elements, such as ignition or ionization electrodes for example.

Although this is not illustrated, this may be the same for the deflector plate 3 described above.

The invention claimed is:

1. A door with a burner for a heating appliance comprising:

an outer door sheet peripherally attached to an inner door sheet to define an interior door space at their respective central portions, the outer door sheet having an inlet opening with an inlet dimension and the inner door sheet having an outlet opening with an outlet dimension;

a gas burner attached to the outlet opening;

a system for feeding a combustible gas mixture to the burner; and an outer deflector disc peripherally attached to an inner deflector disc to define an interior deflector space at their respective central portions, each of the outer and inner deflector discs having a deflector diameter and being fixedly mounted in the interior door space, the inner deflector disc having a bulging central portion, wherein the deflector diameters are greater than and coaxially aligned with the inlet and outlet dimensions, wherein the bulging central portion of the inner deflector disc is adapted to deform elastically with respect to the outer deflector disc so as to absorb any stresses generated by changes in temperature, and wherein the combustible gas mixture flows into the inlet opening and around the outer and inner deflector discs to penetrate into the burner.

2. The door with a burner of claim 1, wherein the inner deflector disc has a peripheral border portion with a plurality of contact zones for attaching the inner deflector disc to the inner door sheet, each contact zone being spaced apart to permit passage of the gas mixture and limit the amount of heat transmitted between the inner deflector disc and the inner door sheet.

3. The door with a burner of claim 2, wherein each contact zone is a boss, pad, or point-like structure.

4. The door with a burner of claim 1, wherein a heat insulator is inserted into the interior deflector space between said inner and outer deflector discs, the heat insulator comprising of a neutral gas or of a solid material.

5. The door with a burner of claim 1, wherein the outer deflector disc has a nipple-shaped central portion with a tip turned towards the inlet opening for promoting the radial distribution of the flow of the gas mixture penetrating through the inlet opening.

6. The door with a burner of claim 1, wherein the portion of the internal face of the inner door sheet that surrounds the outlet opening is lined with a heat resistant and thermally insulating material.

7. The door with a burner of claim 1, wherein said gas burner is annular and said combustion surface is a cylindrical combustion surface centered on the longitudinal door axis.

8. A door with a burner for a heating appliance comprising:

an outer door sheet peripherally attached to an inner door sheet to define an interior door space at their respective central portions, the outer door sheet having an inlet opening with an inlet dimension and the inner door sheet having an outlet opening with an outlet dimension;

an annular mouth portion extending away from the outlet opening to define a burner mount;

a gas burner attached to the burner mount;

a system for feeding a combustible gas mixture to the burner; and an outer deflector disc peripherally attached to an inner deflector disc to define an interior deflector space at their respective central portions, each of the outer and inner deflector discs having a deflector diameter and being fixedly mounted in the interior door space, wherein the inner and outer deflector discs, the gas burner, and the inlet and outlet openings are coaxially aligned along a longitudinal door axis, wherein the combustible gas mixture flows into the inlet opening, around the deflector discs, and through the annular mouth portion to penetrate into the burner, and wherein the deflector diameter is larger than the inlet dimension and the outlet diameter so that the combustible gas mixture licks at least a portion of the outer and inner deflector discs before penetrating the burner.

9. The door with a burner of claim 8, wherein said gas burner has a combustion surface that is mostly transverse with the longitudinal door axis.

10. The door with a burner of claim 8, wherein said gas burner is slightly bulging and said combustion surface is convex and centered on the longitudinal door axis.

11. The door with a burner of claim 8, wherein said gas burner is annular and said combustion surface is a cylindrical combustion surface centered on the longitudinal door axis.

12. The door with a burner of claim 8, wherein the inner deflector disc has a peripheral border portion with a plurality of contact zones for attaching the inner deflector disc to the inner door sheet, each contact zone being spaced apart to permit passage of the gas mixture and limit the amount of heat transmitted between the inner deflector disc and the inner door sheet.

13. The door with a burner of claim 8, wherein a heat insulator is inserted into the interior deflector space between said inner and outer deflector discs, the heat insulator comprising of a neutral gas or of a solid material.

14. A door with a burner for a heating appliance comprising:

an outer door sheet peripherally attached to an inner door sheet to define an interior door space at their respective central portions, the outer door sheet having an inlet opening with an inlet dimension and the inner door sheet having an outlet opening with an outlet dimension;

a gas burner attached to the outlet opening;

a system for feeding a combustible gas mixture to the burner; and an outer deflector disc peripherally attached to an inner deflector disc to define an interior deflector space at their respective central portions, each of the outer and inner deflector discs having a deflector diameter and being fixedly mounted in the interior door space, wherein the deflector diameters are greater than and coaxially aligned with the inlet and outlet dimensions, wherein the combustible gas mixture flows into the inlet opening and around the outer and inner deflector discs to penetrate into the burner, and wherein the central portion of the outer deflector disc is adapted to radially distribute the flow of combustible gas mixture around the outer deflector disc and into the burner.

15. The door with a burner of claim 14, wherein the heating appliance has a wall and said door is removably attached to and sealed against a frame portion of said wall by a peripheral gasket seal.

16. The door with a burner of claim 14, wherein the system for feeding the combustible gas mixture comprises a sleeve attached to said outer door sheet at the inlet opening.

17. The door with a burner of claims 14, wherein an electric motor fan is attached to said outer door sheet and adapted to suck the gas mixture through said inlet opening and discharge the gas mixture towards the burner.

18. The door with a burner of claim 14, wherein the inner deflector disc has a peripheral border portion with a plurality of contact zones for attaching the inner deflector disc to the inner door sheet, each contact zone being spaced apart to permit passage of the gas mixture and limit the amount of heat transmitted between the inner deflector disc and the inner door sheet.

19. The door with a burner of claim 14, wherein a heat insulator is inserted into the interior deflector space between said inner and outer deflector discs, the heat insulator comprising of a neutral gas or of a solid material.

20. The door with a burner of claim 14, wherein said gas burner is annular and said combustion surface is a cylindrical combustion surface centered on the longitudinal door axis.

* * * * *